340-552 SR
7/15/80 OR 4,213,122

United States Patent [19]
Rotman et al.

[11] 4,213,122
[45] Jul. 15, 1980

[54] INTRUSION DETECTION SYSTEM

[75] Inventors: Walter Rotman, Brighton; Nicholas V. Karas, Lowell; Ronald L. Fante, Reading; Peter R. Franchi, Winchester, all of Mass.

[73] Assignee: The United States of America as represented by the Secretary of the Air Force, Washington, D.C.

[21] Appl. No.: 936,159

[22] Filed: Aug. 23, 1978

[51] Int. Cl.[2] ..... G08B 13/18
[52] U.S. Cl. ..... 340/552; 179/82; 343/742; 455/41
[58] Field of Search ..... 340/552, 553, 561, 539, 340/562, 564; 343/5 PD, 842, 742, 832; 325/29, 357; 179/82

[56] References Cited

U.S. PATENT DOCUMENTS

| | | | |
|---|---|---|---|
| 2,355,395 | 8/1944 | Rubenstein | 340/561 |
| 3,237,105 | 2/1966 | Kalmus | 340/562 |
| 3,439,358 | 4/1969 | Salmons | 340/552 |
| 3,794,992 | 2/1974 | Gehman | 343/5 PD |
| 3,815,130 | 6/1974 | Hayo | 343/5 PD |
| 3,896,425 | 7/1975 | Erichsen | 343/5 PD X |
| 4,135,185 | 1/1979 | Rotman et al. | 340/552 |

*Primary Examiner*—John W. Caldwell, Sr.
*Assistant Examiner*—Joseph E. Nowicki
*Attorney, Agent, or Firm*—Joseph E. Rusz; Sherman H. Goldman

[57] ABSTRACT

An intrusion detection system utilizes a radio frequency radiative system whose near electromagnetic field is monitored by receiving devices which respond, in a measurable way, to any disturbance of the near electromagnetic field by physical intrusion.

9 Claims, 10 Drawing Figures

INTRUSION DETECTION SYSTEM

STATEMENT OF GOVERNMENT INTEREST

The invention described herein may be manufactured and used by or for the Government for governmental purposes without the payment of any royalty thereon.

BACKGROUND OF THE INVENTION

The radio frequency intruder detection system of the present invention provides a substantially improved method of securing the physical integrity of a variety of metal structures of varying shapes and sizes by detecting any attempts to penetrate through a zone of protection which surrounds the metal structures. One of the metal structures which may be protected is an airplane. Another is a vehicle such as a trailer or any other similar object. Still another is a metal housing such as a hangar.

SUMMARY OF THE INVENTION

A radio frequency intrusion detection system is provided. The invention uses the metal structure to be protected as one part of a radiating antenna system. The metal structure is energized against ground thus establishing strong near electromagnetic fields completely surrounding the metal structure. These near fields are monitored by radio frequency pickup devices which detect any changes from the quiescent, undisturbed or normal state of the near field electromagnetic pattern.

DETAILED DESCRIPTION OF THE PREFERRED EMBODIMENT

Figure 1A:
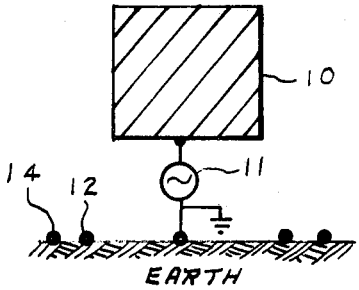
FIG. 1*a* shows the feeding mechanism of the metal structure for the detection system.

Now referring to FIG. 1*a*, metal structure 10 energized by RF source 11 is schematically shown as a floating rectangular volume above ground. Obviously real structures have under-supports. It is also noted that the intrusion detection system is independent of the kind and shape of the metal structure.

Figure 1B:
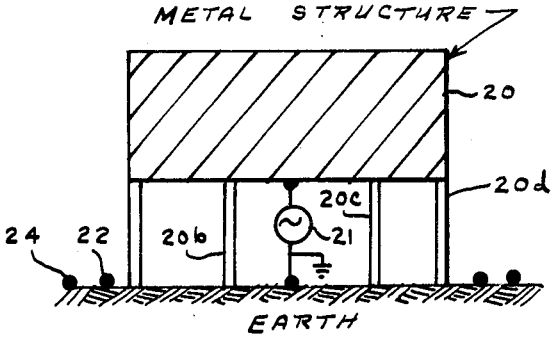
FIG. 1*b* shows the feeding mechamism for the metal structure with supports for the metal structure.

FIG. 1*b* shows metal structure 20 energized by RF source 21. Metal structure 21 is illustrated with under-supports 20*a*–20*c*. These under-supports are electrically nonconducting such as concrete. There are many other under-supports that may be utilized in place thereof, the only requirement being that they are electrically nonconductive and electrically insulate the metallic structure from ground.

Metallic structures 10 and 20 to be protected are fed by radio frequency sources 11 and 21 of FIGS. 1*a* and 1*b*, respectively, in an unbalanced (coaxial) mode, with the structure being the "hot" side (currents are induced on its surface) and earth being the "cold" side (ground). An efficient ground is a loop of wires 12 and 22 surrounding the structure, near and approximately parallel (or concentric) to receiver wires 14 and 24 of FIGS. 1*a* and 1*b*, respectively. This configuration tends to concentrate the near fields in the vicinity of the two wires; concentrated near fields react more strongly to any disturbances caused by an intruder. The feed point (whether at the center of the structure, at either end, or in between) is discretionary, depending upon ease of attachment of generator to structure; availability of feed location; preferred enhancement of detection in a particular direction (by change in pattern shape) with the near field still retaining its 360 degree coverage, and avoidance of obstructions that might interfere with maximum energizing of the structure. The feeding radio frequency energy can be CW, modulated, or pulsed. The preferred frequency range of operation is between 72 and 76 MHz. However, the system operates at other frequencies (tests have been conducted with frequencies as high as 90 MHz and as low as 60 MHz) but at reduced sensitivity.

Figure 2A:
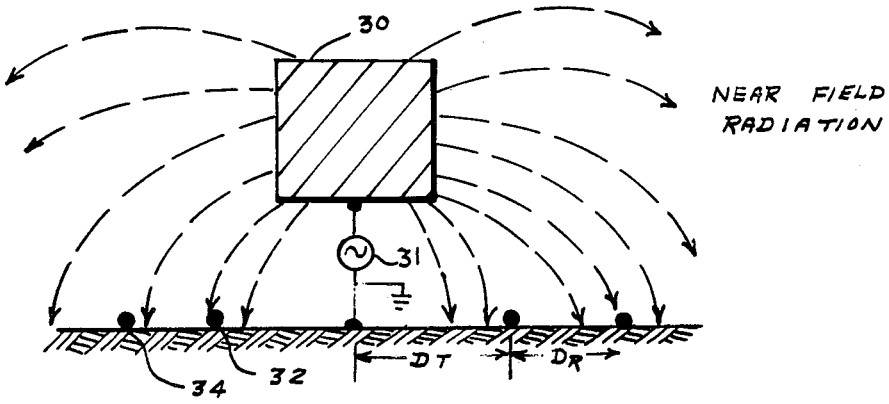
FIG. 2*a* shows the basic detection system and its near field radiation.
Figure 2B:
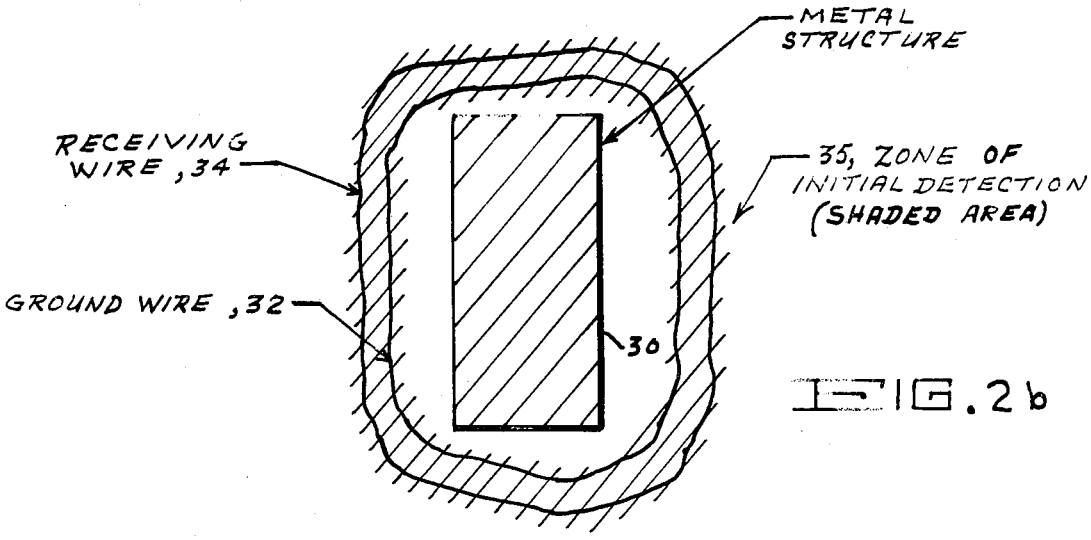
FIG. 2*b* illustrates schematically in a top view of FIG. 2*a* the near field electromagnetic radiation and zone of coverage for the intrusion detection system for the metal structure.

As shown in FIGS. 2*a* and 2*b*, basically metallic structure 30 operates as an antenna with relatively strong near fields. The concentration of the near fields can be partly controlled by the distance, DT, from metallic structure 30, at which ground wire 32 is placed, and also the distance, DR, between ground wire 32 and receiving wire 34. Receiving wire 34 is part of the detection system which will be explained later. The wires need not conform to any particular geometric shape (including the specific shape of the protected structure) and do not even need to be continuous. However, for relatively uniform detection strength the ground wire and the receiver wire should be approximately parallel or concentric (depending upon the layout of the wires). The power required to energize the metallic structure, as used in the initial experiments, was between 50 and 100 milliwatts. However, this power can, no doubt, be severely lowered for no attempt was made to maximize the transfer of power from the generator to the metallic structure, from the near field to the receiver wire; also, no sophisticated detection techniques were employed. Nominally the receiving wire (the option is available of placing it on either side of the ground wire, relative to the metallic structure) should be within $D_R=\lambda/2$ of the ground wire ($\lambda f=c$, f=operating frequency of the signal generator feeding the metallic structure, $\lambda$=wavelength, c=velocity of electromagnetic energy). Further separation tends to lessen the sensitivity of the receiving wire; a closer distance tends to confine the near fields between the two wires and restrict the upward and outward thrust of the fields. As shown in FIG. 2*b*, there is omnidirectional control with the zone of initial detection being shaded area 35.

Figure 3:
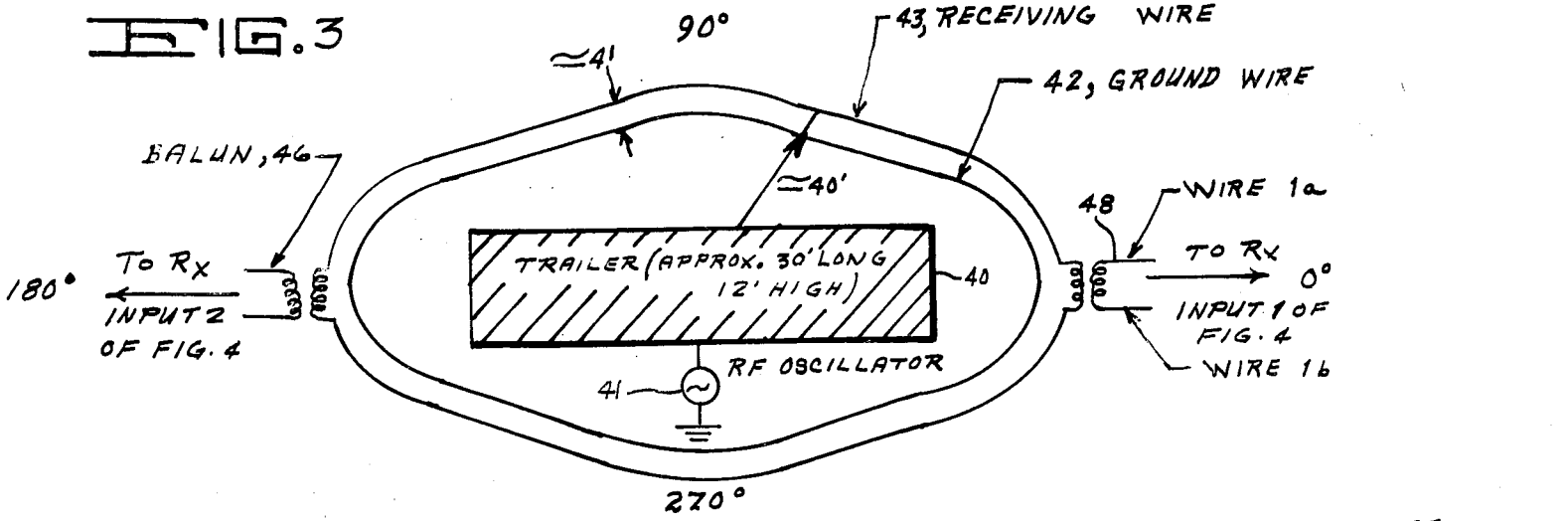
FIG. 3 shows schematically the top view of the intrusion detector system for a metal structure.

As stated before, the receiver wires continually monitor the near field surrounding the metal structure and serve as conduits for the transmission of disturbances of the near field, which appear at the final output as a modulation of the undisturbed signal. This modulation of voltage fluctuation from a steady state output can be viewed visually, as in strip chart recordings, or can be used to trigger an alarm. FIG. 3 shows a schematic of the physical layout of the testing of the system. Radio frequency oscillator 41 feeding metal structure 40 was modulated at 1000 Hz. Only one receiver input (input 1, input 2 shorted) was used in the initial experiment, and the received signal was detected by two crystals (1N21B), one for each wire (wires 1*a* and 1*b* in FIG. 3). Then each detected signal was fed into separate 1000 Hz amplifiers, from which a DC output was fed into a conventional two-channel strip chart recorder. Conventional baluns 4 and 48 were utilized to obtain a signal output.

There is also provided a modified technique and system for improving overall system sensitivity, particularly, increasing the sensitivity of the entry at 180 degrees. Filtering is also utilized to limit system noise; non-human disturbances, and other disturbances (either environmental or structural) which could cause perturbation in the near field and thereby trigger false alarm, i.e., structural flapping of airplane wings in high wind. Finally, there is established a control of the threshold level at which a voltage fluctuation could trigger an alarm thus lowering the false alarm rate.

Figure 4:
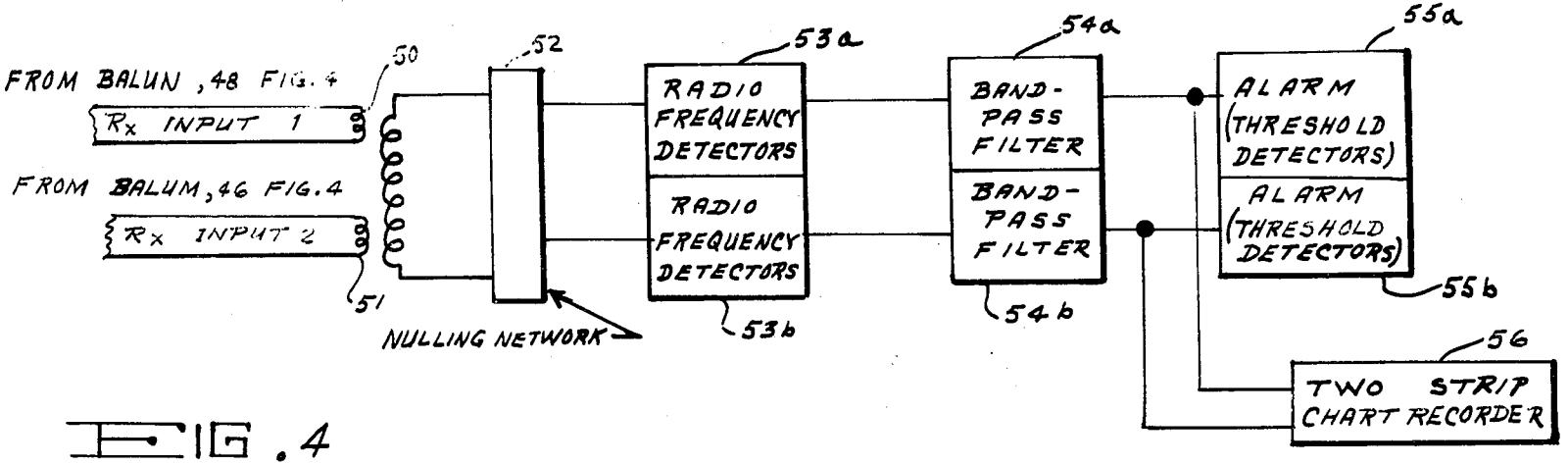
FIG. 4 illustrates a block diagram of the receiving apparatus for the intrusion detector system.

The modified system is shown schematically in FIG. 4. Two receiving ports are included, one at 0 degrees and the second at 180 degrees. There is no restriction on the number of ports other than consideration of practicality for the size of the structure and the area to be protected.

Baluns 50 and 51 receive their input signals from the outputs from baluns 48 and 46 of FIG. 4, respectively. Nulling network 52 receives first and second signals, representative of the signals provided by the 0° and 180° output ports of FIG. 4. The output signals from nulling network 52 are fed through radio frequency detectors 53*a* and 53*b*, bandpass filters 54*a* and 54*b* to threshold alarm detectors 55*a* and 55*b*, respectively. Two-channel strip chart recorder 56 receives actuating signals from bandpass filters 54*a* and 54*b*. Threshold alarm detectors 55*a* and 55*b* each have associated therewith an alarm actuated by the threshold detectors. Bandpass filters 54*a* and 54*b* are typically designed to be between 0.01–10 Hz.

Nulling network 52 is not required and may be eliminated. However, with nulling network 52 inserted it gives significantly more sensitivity to the system thereby extending significantly the width of the zone protection. Nulling network 52 may be in the form of a phase control circuit. By manipulation of the aforementioned phase control circuit or by proper selection of wire lengths to radio frequency detectors 53*a* and 53*b*, the undisturbed state signals can be made to cancel any desired null depth. Therefore, even minor perturbations which may have been masked by riding on high steady state signals can be detected.

Figure 5:
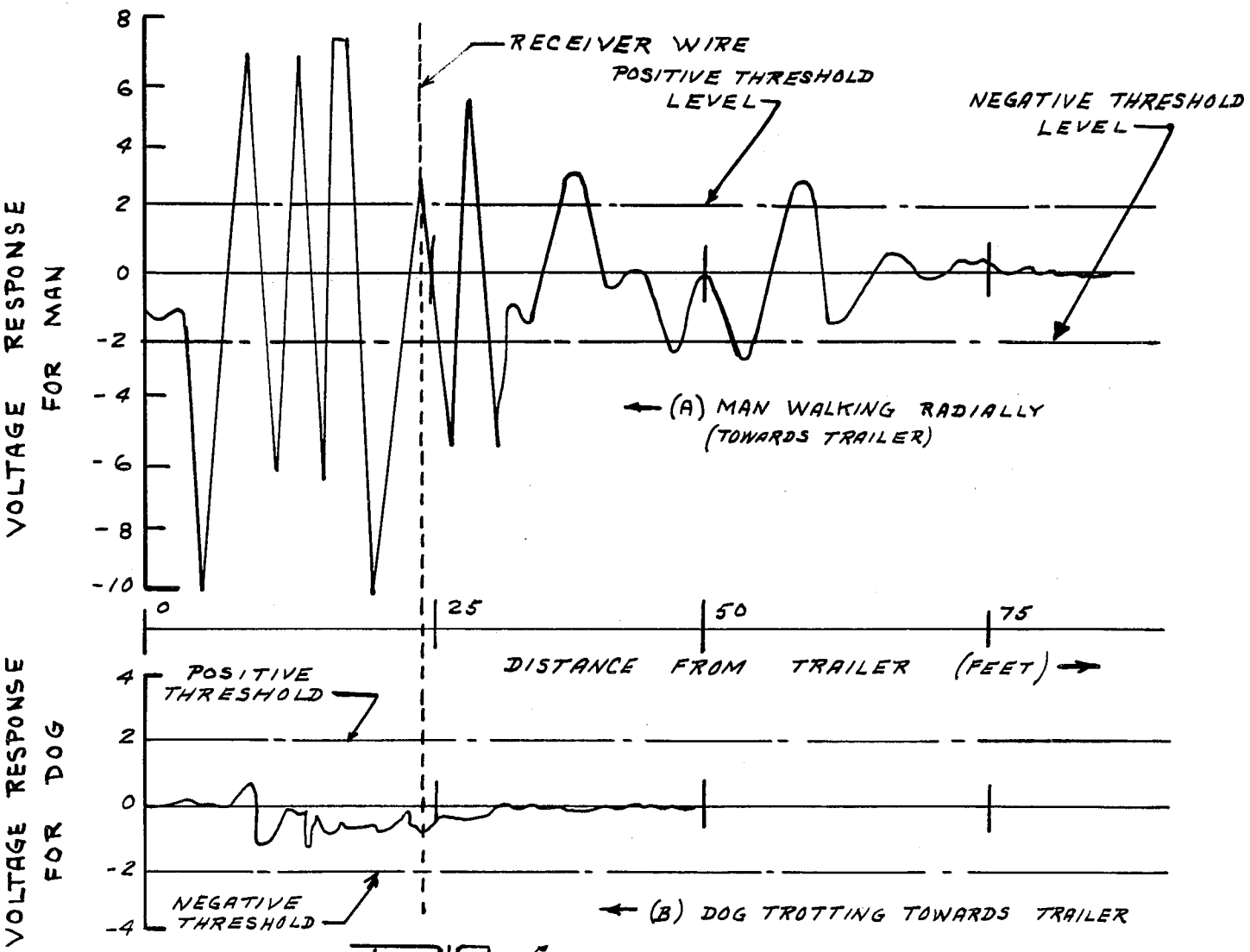
FIG. 5 shows the radial response of a vehicle intruder protection system (VIPS)
Figure 6:
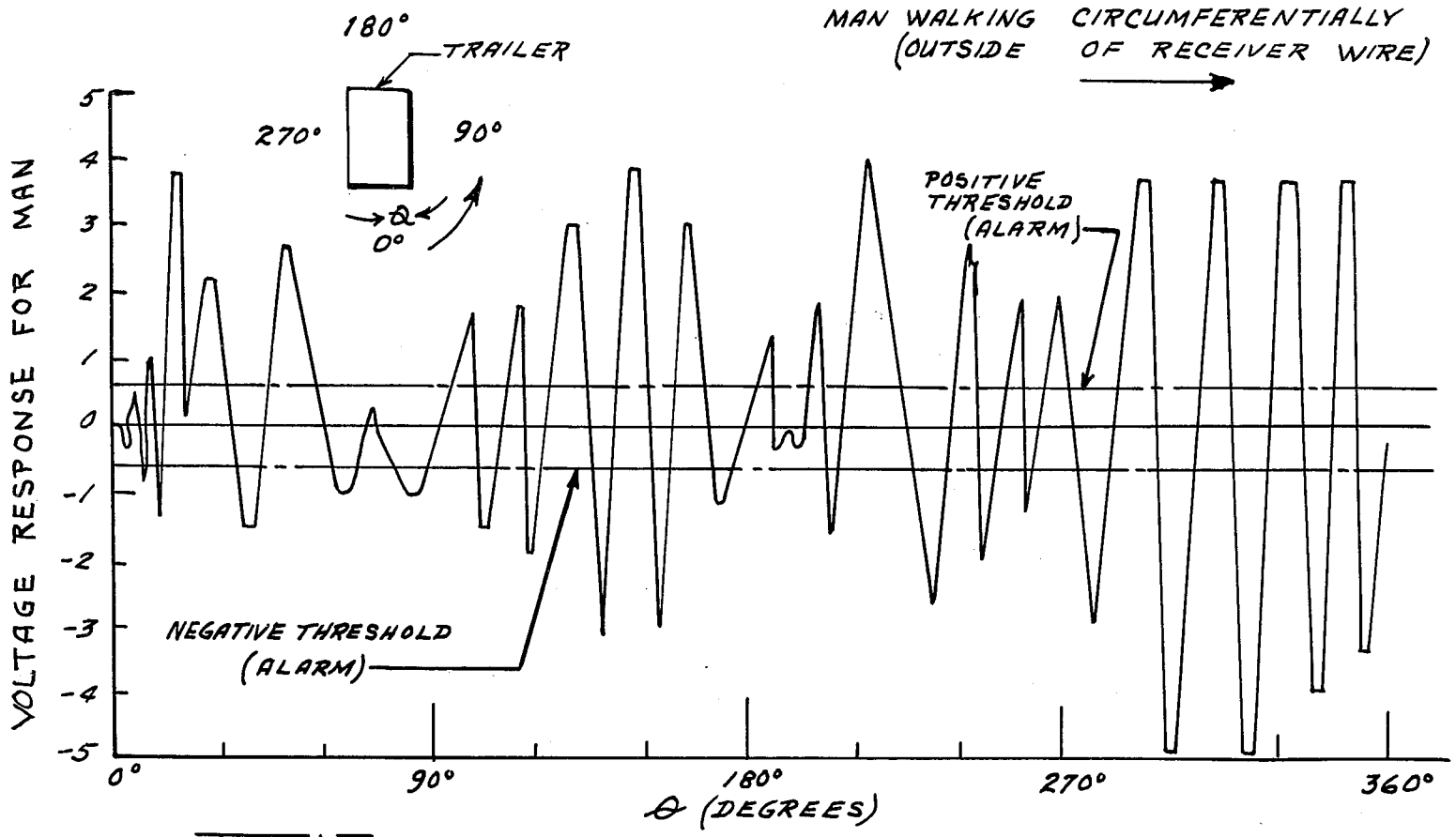
FIG. 6 shows the circumferential response of a vehicle intruder protection system (VIPS)

FIG. 5 shows the voltage fluctuations (or voltage modulations) caused by an adult male approaching metal structure 40 (trailer) radially. When any voltage spike exceeded the threshold value (which triggers the alarm and is preset) the system alarm sounded to show the false alarm rejection capability of the system. FIG. 5 on a separate curve illustrates the fluctuation caused by a dog trotting toward the trailer radially along the same path as the adult. Both of the illustrations shown in FIG. 5 were transcribed from the actual strip chart recordings. As a further illustration of the detection system's capability, FIG. 6 shows that the trailer is protected the full 360 degrees.

Figure 7:
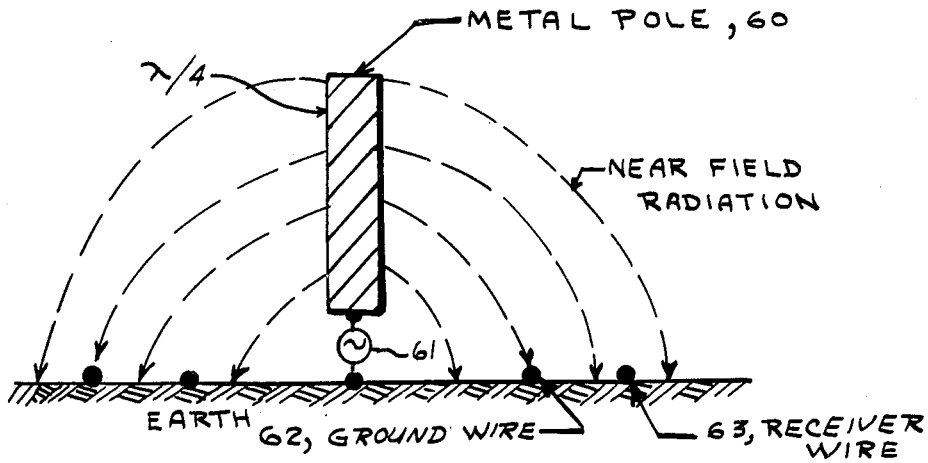
FIG. 7 shows schematically a monopole intrusion detection system.

A further embodiment of the invention is provided. All the previous descriptions dealt with the procedure of energizing a metallic structure. However, if an area is to be protected, or if there are no metallic structures, the system illustrated in FIG. 7 can be utilized. As shown in FIG. 7, simple metal pole 60 (monopole) whose length is approximately a quarter wavelength of the operating frequency is energized by AC generator 61. Ground wires 62 and receiver wire 63 are provided. There may also be provided the system shown in FIGS. 3 and 4 for the detection and recording of any intrusion disturbance. The near field surrounding the monopole will afford a complete zone of protection.

Figure 7A:
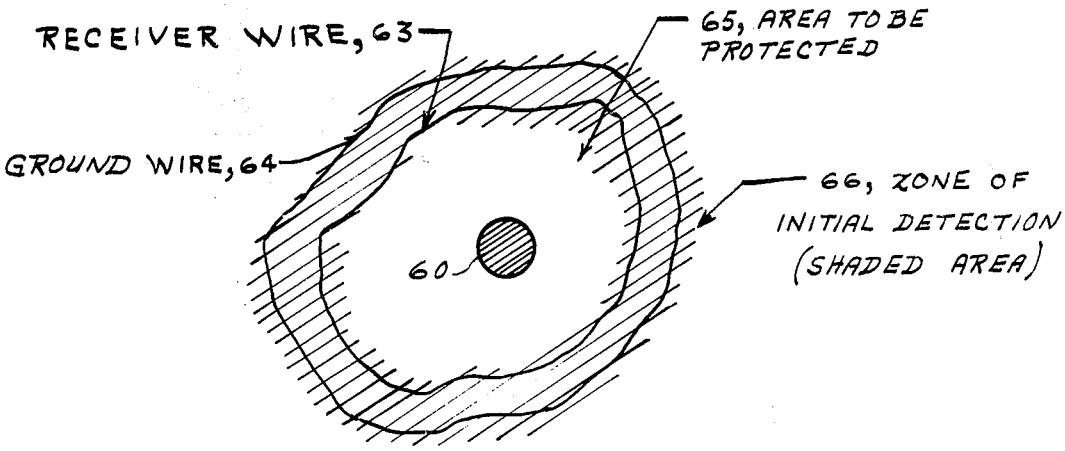
FIG. 7*a* shows in a top view the zone of detection of FIG. 7.

FIG. 7*a* shows a top view of the zone of protection of the system of FIG. 7. There is illustrated therein area 65 to be protected surrounding metal pole 60 and zone of initial detection 66 which is the shaded area.

It is noted that the receiving wire in each of the embodiments should be insulated from the ground either by raising it, sheathing the wire, or laying it on the ground with a dielectric to minimize ground losses and so reduce attenuation of the received radio frequency signals.

In one of the tests of a full scale metallic structure a metal trailer without a cab was used. It was approximately thirty feet long and twelve feet high. The trailer was energized against ground and was circled by a receiver wire laying on the ground at various distances from the trailer (from 15 feet to 40 feet). All attempted intrusions through the zone of protection by humans were detected.

What is claimed is:

1. An intrusion detection system comprising a metallic structure to be protected from intrusion, a first loop of wire surrounding said metallic structure, a second loop of wire near and approximately concentric to said first loop of wire, means to radio frequency energize said metallic structure against ground to concentrate a near electromagnetic field pattern in the vicinity of said first and second wires, said first wire being a ground wire, said second wire being a receiver wire, said ground wire effecting concentration of the near electromagnetic field and in conjunction with said receiver wire defining a detection zone, said receiver wire intercepting and being responsive to the electromagnetic field radiated by said metallic structure, and means coupled to said receiver wire to detect any changes from the quiescent, undesturbed state of the concentrated near electromagnetic field pattern.

2. An intrusion detection system as described in claim 1 further including support means for said metallic structure to electrically insulate said metallic structure from ground.

3. An intrusion detection system as described in claim 2 including means to transfer a first signal from said receiver wire to said means to detect.

4. An intrusion detection system as described in claim 2 including first and second means to transfer first and second signals from said receiver wire to said means to detect.

5. An intrusion detection system as described in claim 4 wherein said means to detect includes first and second radio frequency detectors, receiving said first and second signals, first and second filters having a predetermined bandpass passing the detected signals from said first and second radio frequency detectors, respectively, first and second threshold circuits, each having an associated alarm, said first and second threshold circuits receiving the first and second filtered signals, respectively, and a dual strip chart record also receiving said first and second filtered signals.

6. An intrusion detection system as described in claim 5 further including a nulling circuit interposed between said first and second transfer means and said first and second radio frequency detector means.

7. An intrusion detection system as described in claim 4 wherein said first and second means to transfer is comprised of first and second baluns, respectively.

8. An intrusion detection system as described in claim 1 wherein said metallic structure consists of a monopole.

9. An intrusion detection system as described in claim 6 wherein said metallic structure consists of a monopole.

* * * * *